US005081767A

United States Patent [19]

Wijma

[11] Patent Number: 5,081,767

[45] Date of Patent: Jan. 21, 1992

[54] SHAVING APPARATUS

[75] Inventor: Willem S. Wijma, Drachten, Netherlands

[73] Assignee: U.S. Philips Corp., New York, N.Y.

[21] Appl. No.: 536,903

[22] Filed: Jun. 12, 1990

[30] Foreign Application Priority Data

Jul. 10, 1989 [NL] Netherlands ..... 8901754

[51] Int. Cl.[5] ..... B26B 19/02

[52] U.S. Cl. ..... 30/43.92

[58] Field of Search ..... 30/43.92, 364.51

[56] References Cited

U.S. PATENT DOCUMENTS 2,234,891 3/1941 Bruecker ..... 30/364.51 X
2,982,020 5/1961 Bulova et al. ..... 30/364.51 X
3,694,916 10/1972 Harms et al. ..... 30/346.51 X
4,134,202 1/1979 Buchholz ..... 30/43.92
4,381,603 5/1983 Schreiber et al. ..... 30/43.92

FOREIGN PATENT DOCUMENTS 1025299 2/1958 Fed. Rep. of Germany ... 30/364.51

*Primary Examiner*—Z. R. Bilinsky
*Attorney, Agent, or Firm*—Ernestine C. Bartlett

[57] ABSTRACT

A shaving apparatus is provided comprising a foil having hair entrance apertures and a shaving member which can be driven with respect to the foil, which apparatus comprises a foil holder having supporting parts corresponding to the shape of the foil. The foil holder comprises at least one adjustable connection member for the foil.

3 Claims, 3 Drawing Sheets

SHAVING APPARATUS

FIELD OF THE INVENTION

The invention relates to a shaving apparatus comprising a foil having hair entrance apertures and a shaving member which can be driven with respect to the foil, the apparatus comprising a foil holder having supporting parts corresponding to the shape of the foil.

BACKGROUND OF THE INVENTION

Such a shaving apparatus is known, for example, from U.S. Pat. No. 2,797,479 in which the foil is permanently connected to the foil holder. If the foil has become defective, the assembly of foil holder and foil should be replaced. Because the foil holder determines the shape of the foil the foil should engage the foil holder without play. As a result of this a high degree of accuracy is required so that the manufacture of the said known combination of foil and foil holder is comparatively expensive.

SUMMARY OF THE INVENTION

An object of the invention is to improve a shaving apparatus of the type described hereinbefore with respect to ease of replacement and the need for accuracy in the fit of the foil and foil holder and the relative expense involved in providing the same. The invention is characterized in that the foil holder comprises at least one adjustable connection member for the foil.

In special embodiments of the invention: (a) the foil can be put under pressure against the supporting parts of the holder by means of the adjustable connection member; (b) the adjustable connection member may be formed by a rotatable cam having an eccentric part which is situated in a corresponding aperture of the foil; (c) the foil is also connected to the holder by means of a resilient element; and/or (d) the resilient element forms part of a reinforcing edge of the foil.

BRIEF DESCRIPTION OF THE DRAWINGS

The invention will now be described in greater detail with reference to a description of a few embodiments shown in the Figures.

DESCRIPTION OF PREFERRED EMBODIMENTS

Figure 1:
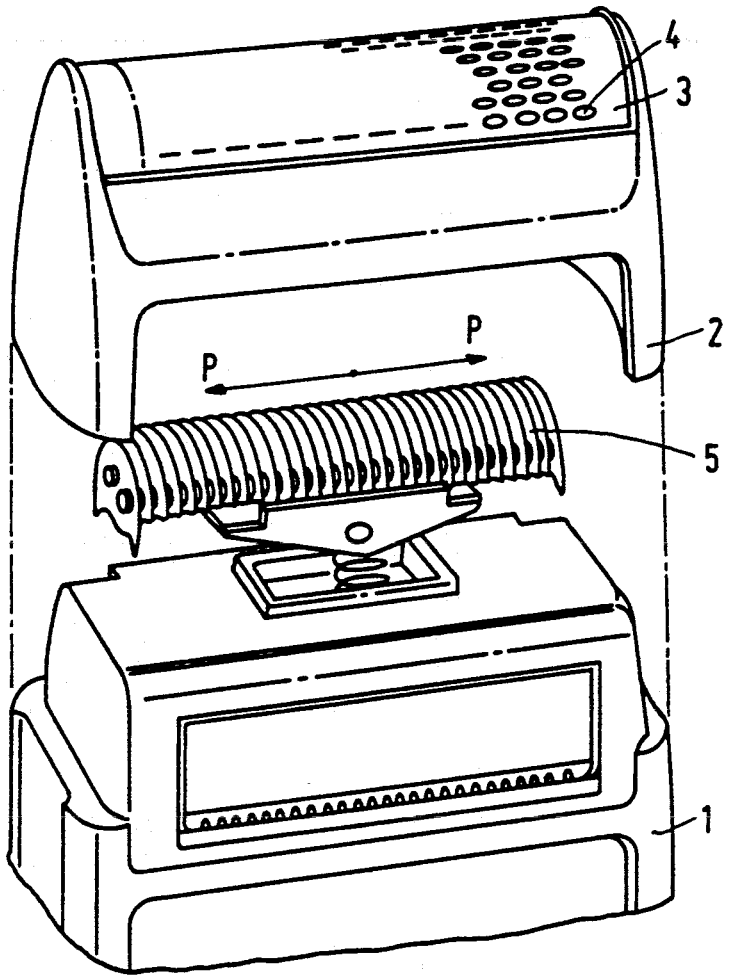
FIG. 1 is a perspective view of a shaving apparatus in which the foil holder with foil has been disassembled.

The shaving apparatus of FIG. 1 comprises a housing 1 and a detachable foil holder 2 comprising a foil 3 having hair entrance apertures 4. A shaving member 5 can be driven in known manner so as to reciprocate with respect to the foil 3 in the direction of the arrows P.

Figure 2:
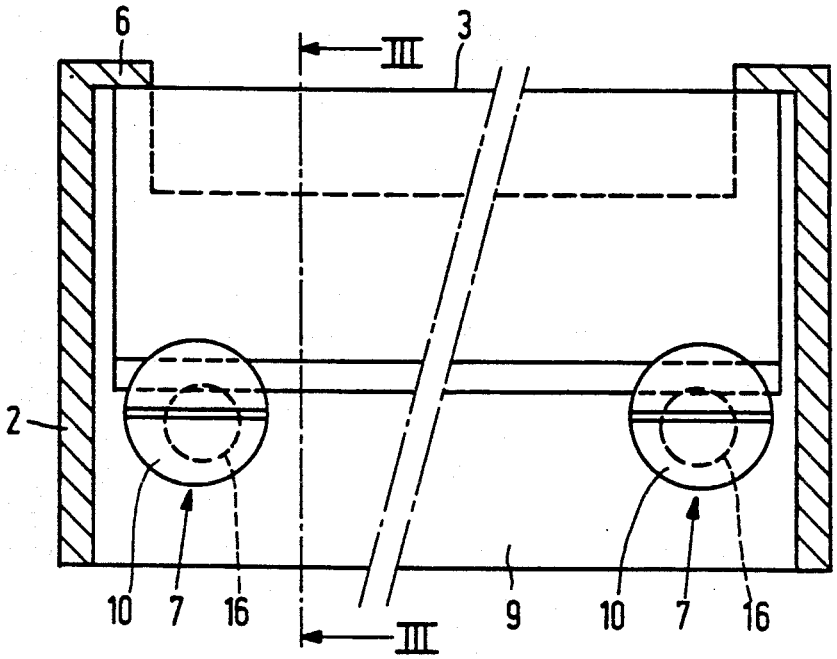
FIG. 2 is a diagrammatic longitudinal sectional view of the foil with foil holder.
Figure 3:
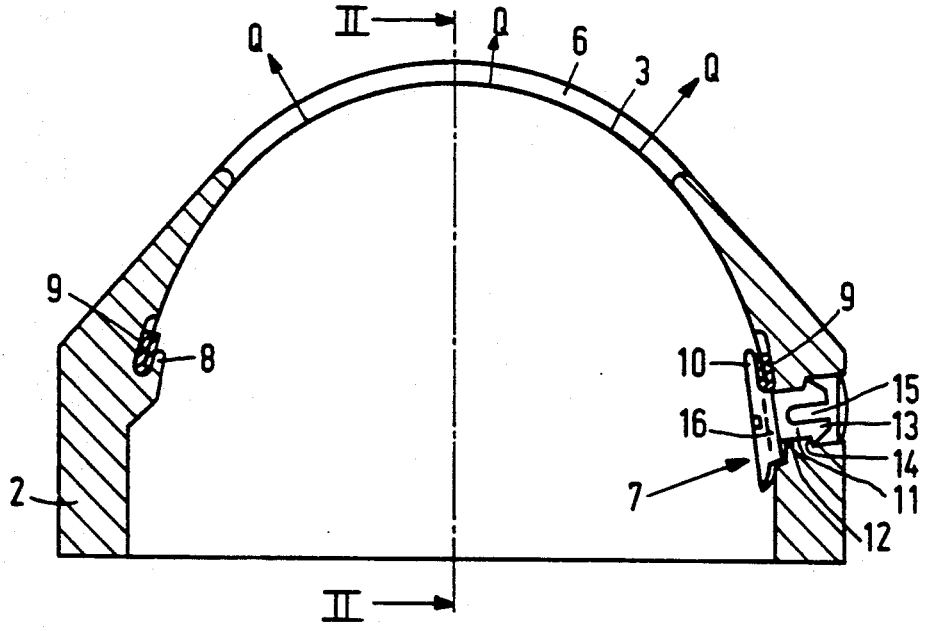
FIG. 3 is a cross-sectional view taken on the line III—III of FIG. 2.

As is shown in FIGS. 2 and 3 the foil holder 2 comprises supporting parts which correspond to the curved shape of the foil 3 and which are formed by the projecting edge portions 6 of the foil holder.

On one side of the foil holder 2 the foil 3 is supported by two adjustable connection means 7 and on the other side it is supported by two oppositely located hook-like cams 8. The edges of the foil 3 are provided with reinforcing edges 9.

An adjustable connection means is constructed as a rotatable cam 7 having a circular flange 10 and a first cylindrical part 11 which is coaxial therewith and which is situated in an aperture 12 of the foil holder 2. The cylindrical part 11 comprises hook-like ends 13 which engage behind the wall part 14 of the foil holder 2. As a result of the incision 15 in the cylindrical part 11 the hook-like ends can deviate elastically so that assembly and disassembly of the rotatable cams 7 becomes possible. A second cylindrical part 16 which is situated eccentrically with respect to the first cylindrical part 11 is present between the flange 10 and the first cylindrical part 11.

The foil 3 bears with a reinforcing edge 9 against the second eccentric cylindrical parts 16 of the cams 7. Any play between the cams 7 and 8 and the foil 3 may be removed by rotating the cams 7 and forces may also be exerted on the foil so that it is tensioned in the holder 2. The foil 3 then engages the edge parts 5 with a pressure Q as a result of which the curved shape of the foil corresponds exactly to the shape of the said edge parts and which shape is chosen optimally, for example, for the operation of the apparatus. Because the foil 3 engages the foil holder 2 with a pressure Q the foil will be urged away from the holder less rapidly during shaving so that the occurrence of play between foil 3 and shaving member 5 and hence a deterioration of the shaving action is avoided.

Figure 4:
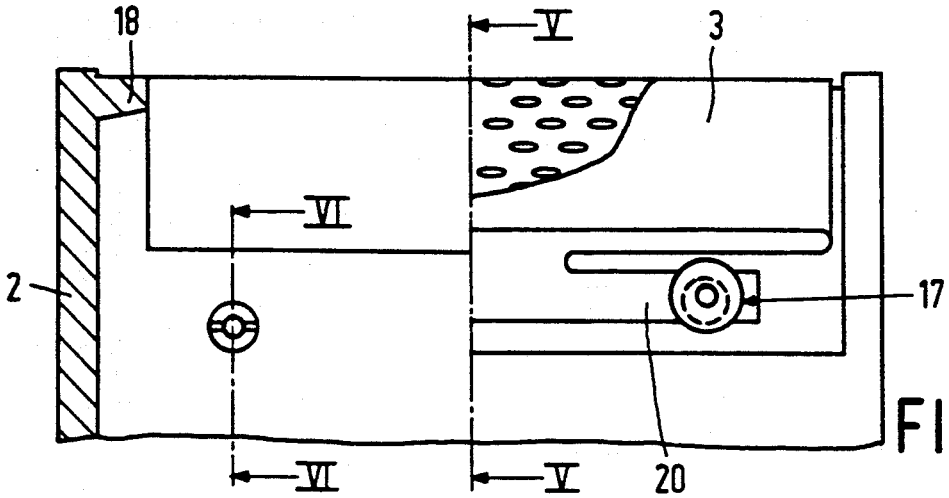
FIG. 4 is a longitudinal sectional view partly as an elevation of the foil and foil holder of another embodiment.
Figure 5:
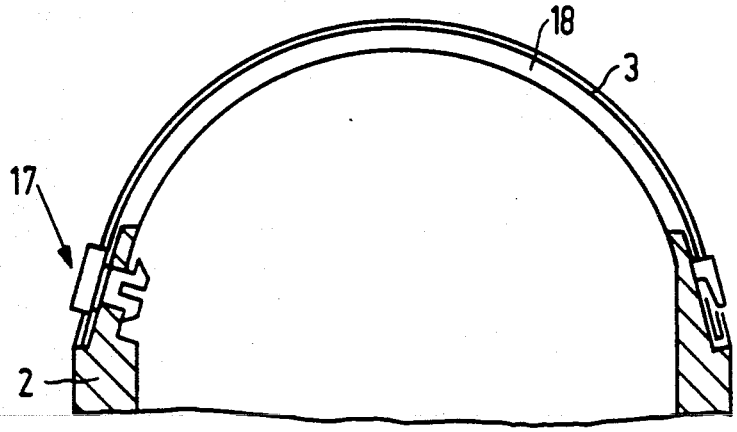
FIG. 5 is a cross-sectional view taken on the line V—V in FIG. 4.
Figure 6:
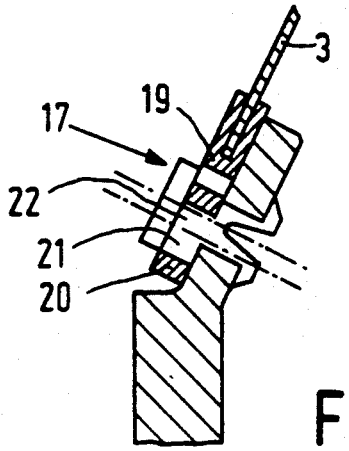
FIG. 6 is a cross-sectional view on an enlarged scale taken on the line VI—VI in FIG. 4.

FIGS. 4, 5 and 6 show an embodiment in which the foil 3 is situated on the outside of the foil holder 2. The foil 3 is drawn over the edge parts 18 by means of the rotatable cams 17 which are constructed entirely in accordance with the cams 7 of the embodiment shown in FIGS. 1 to 3. The reinforcing edge 19 of the foil 3 comprises resilient elements in the form of elastic arms 20 having apertures 21 in which the eccentric cylindrical parts 22 of the cams 17 are situated.

I claim:

1. A shaving apparatus comprising a foil having hair entrance apertures and a shaving member which can be driven with respect to the foil, which apparatus comprises a foil holder having supporting members corresponding to the shape of the foil, the foil holder comprising at least one adjustable connection member for the foil and wherein the foil can be put under pressure against the supporting parts of the holder by means of the adjustable connection member, the adjustable connection member being formed by a rotatable cam having an eccentric part which is situated in a corresponding aperture of the foil.

2. A shaving apparatus as claimed in claim 1 where the foil is also connected to the holder by means of a resilient element.

3. A shaving apparatus as claimed in claim 2 wherein the resilient element forms part of a reinforcing edge of the foil.

* * * * *